US007021003B2

(12) United States Patent
Daniels et al.

(10) Patent No.: US 7,021,003 B2
(45) Date of Patent: Apr. 4, 2006

(54) ROD ON RAIL POWER LIFTGATE DRIVE MECHANISM

(75) Inventors: Andrew R. Daniels, Newmarket (CA); Miroslav Janda, Toronto (CA); Alexander Kaczmarczyk, Aurora (CA); Kathryn Petroff, East York (CA)

(73) Assignee: Atoma International Corp., Newmarket (CA)

( * ) Notice: Subject to any disclaimer, the term of this patent is extended or adjusted under 35 U.S.C. 154(b) by 98 days.

(21) Appl. No.: 10/258,827

(22) PCT Filed: Apr. 27, 2001

(86) PCT No.: PCT/CA01/00574

§ 371 (c)(1),
(2), (4) Date: Oct. 25, 2002

(87) PCT Pub. No.: WO01/83247

PCT Pub. Date: Nov. 8, 2001

(65) Prior Publication Data

US 2003/0136054 A1 Jul. 24, 2003

Related U.S. Application Data

(60) Provisional application No. 60/200,048, filed on Apr. 27, 2000.

(51) Int. Cl.
*E05F 11/24* (2006.01)

(52) U.S. Cl. ..... 49/340; 296/56

(58) Field of Classification Search ..... 49/339, 49/340, 344, 324, 139, 140; 296/56, 146.4, 296/146.11

See application file for complete search history.

(56) References Cited

U.S. PATENT DOCUMENTS

| | | | | |
|---|---|---|---|---|
| 5,588,258 | A | 12/1996 | Wright et al. | |
| 6,055,775 | A * | 5/2000 | Dering et al. | 49/340 |
| 6,202,350 | B1 * | 3/2001 | Montgomery et al. | 49/139 |
| 6,367,199 | B1 * | 4/2002 | Sedlak et al. | 49/340 |
| 6,367,864 | B1 * | 4/2002 | Rogers et al. | 296/146.4 |
| 6,453,614 | B1 * | 9/2002 | Rogers et al. | 49/340 |
| 6,637,157 | B1 * | 10/2003 | Dombrowski et al. | 49/341 |

FOREIGN PATENT DOCUMENTS

| | | |
|---|---|---|
| FR | 2 717 215 A1 | 3/1994 |
| FR | 2 730 714 A1 | 2/1995 |

* cited by examiner

*Primary Examiner*—Jerry Redman
(74) *Attorney, Agent, or Firm*—Clark Hill PLC

(57) ABSTRACT

A power liftgate drive assembly moves a liftgate of a motor vehicle between an open position and a closed position. The power liftgate assembly is aligned along the side of the motor vehicle. A liftgate rod extends in a generally vertical orientation between the power liftgate drive assembly and the liftgate. The assembly includes a base that is fixedly secured to the motor vehicle near a load floor. A guide extends upwardly from the base. The guide extends along the side of the motor vehicle and is disposed adjacent the liftgate when the liftgate is in the closed position. A liftgate carriage is connected to the guide. The liftgate carriage slides along the guide. The liftgate rod is pivotally connected between the liftgate carriage and the liftgate. The liftgate rod translates the linear movement of the liftgate carriage into the pivotal movement of the liftgate to move the liftgate between the open and closed positions

18 Claims, 4 Drawing Sheets

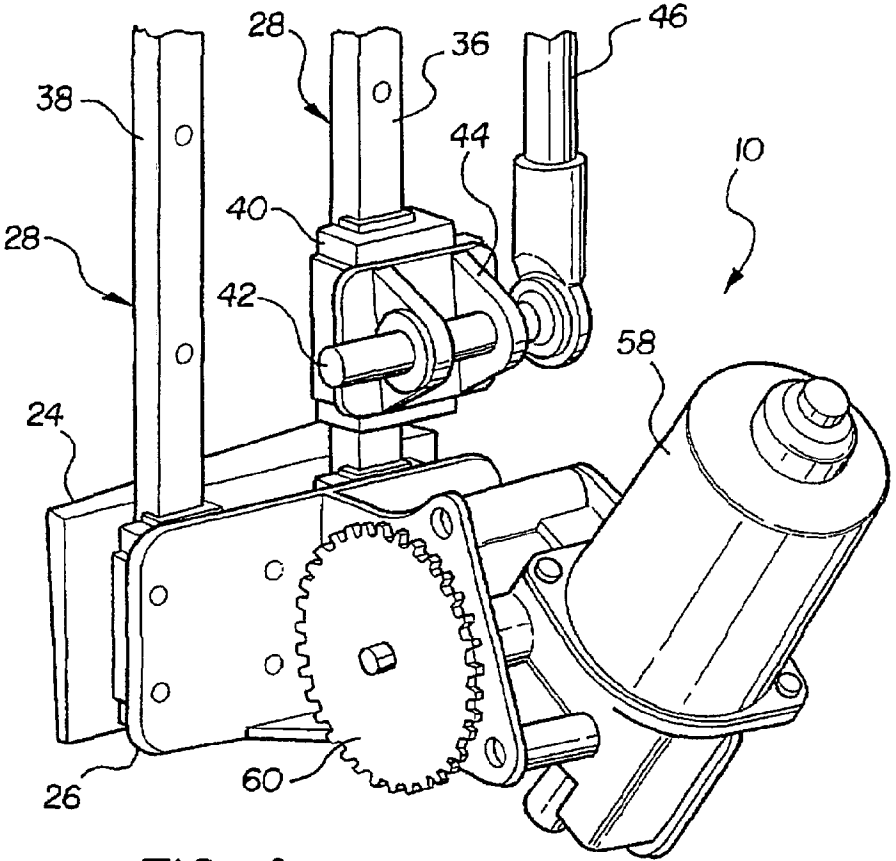
FIG-4
FIG-3
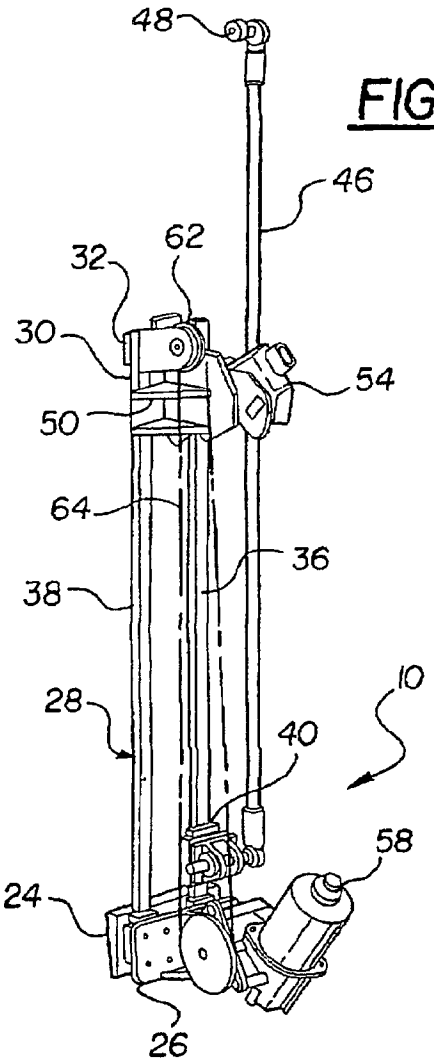

ROD ON RAIL POWER LIFTGATE DRIVE MECHANISM

RELATED APPLICATIONS

This patent application claims priority to PCT Application Filing PCT/CA01/055574 which was filed claiming priority to U.S. provisional patent application 60/200,048.

FIELD OF THE INVENTION

The invention relates to all assembly extending along one side of a motor vehicle for opening and closing a liftgate. More specifically, the invention relates to an automated assembly designed to move a liftgate of a motor vehicle between an open position and a closed position.

DESCRIPTION OF THE RELATED ART

Motor vehicles commonly include a liftgate typically connected to the rear of the vehicle. These liftgates are pivotal between an open position and a closed position to selectively provide access to the rear compartment of the vehicle. These liftgates are typically manually operated by pivoting the liftgate about a pair of hinges between the open and closed positions. A pair of hydraulic or pneumatic cylinders are often connected between the liftgate and the vehicle to assist in the opening of the liftgate and in maintaining the liftgate in the open position.

There is a desire to provide operators of motor vehicles with the ability to open and close liftgates free of manual assistance. This feature of providing power to a liftgate in a manner that moves the liftgate between its two extreme positions could be easily obtained if the task were merely to provide and remove access to a compartment within a motor vehicle. The task is, however, more extensive than that. The ability to open and close the compartment must be provided only when it is coupled with the ability to manually move the liftgate without having to provide an additional force to overcome the automation system. Further, the assembly that creates the force to automatically move the liftgate must be lightweight and minimally impact the capacity of the compartment to which the liftgate provides access.

Attempts have been made to provide a power liftgate drive mechanism that will automatically raise or lower the liftgate between its open and closed positions. U.S. Pat. No. 5,448,856, issued to Moore et al. on Sep. 12, 1995, discloses a powered liftgate mechanism. This mechanism includes a motor which moves a crank arm using an assembly that includes a worm shaft and gears. While the motor provides a force to move the liftgate between its open and closed positions, it requires the assistance of gas springs or struts to move the liftgate. Little mechanical advantage is provided by the powered liftgate mechanism. Therefore, when using the mechanism disclosed in this patent, modifications to the motor vehicle are required before the liftgate mechanism may operate correctly.

SUMMARY OF THE INVENTION

A power liftgate drive assembly moves a liftgate of a motor vehicle between an open position and a closed position. The power liftgate assembly includes a base that is fixedly secured to the motor vehicle. A guide extends upwardly from the base. The guide is disposed adjacent the liftgate when the liftgate is in the closed position. A liftgate carriage is connected to the guide. The liftgate carriage slides along the guide. A liftgate rod is pivotally connected between the liftgate carriage and the liftgate. The liftgate rod translates the linear movement of the liftgate carriage into the pivotal movement of the liftgate to move the liftgate between the open and closed positions.

BRIEF DESCRIPTION OF THE DRAWINGS

Advantages of the invention will be readily appreciated as the same becomes better understood by reference to the following detailed description when considered in connection with the accompanying drawings, wherein:

FIG. 3 is a perspective view of one embodiment of the invention;

FIG. 4 is a perspective view, partially cut away, of a drive mechanism incorporated into one embodiment of the invention;

DETAILED DESCRIPTION OF THE PREFERRED EMBODIMENT

Figure 2:
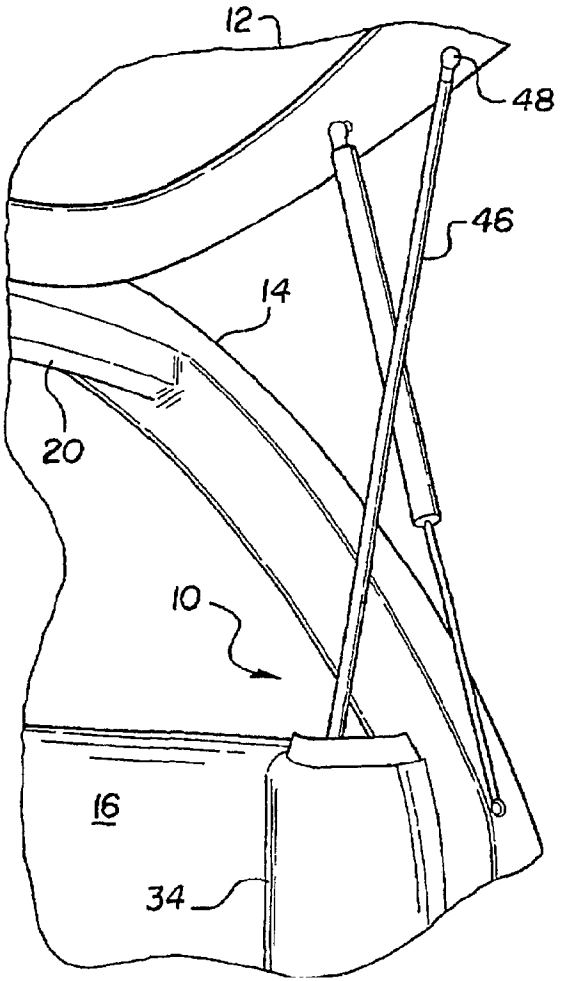
FIG. 2 is a perspective view, partially cut away, of a motor vehicle incorporating the invention with a cover over the invention.
Figure 1:
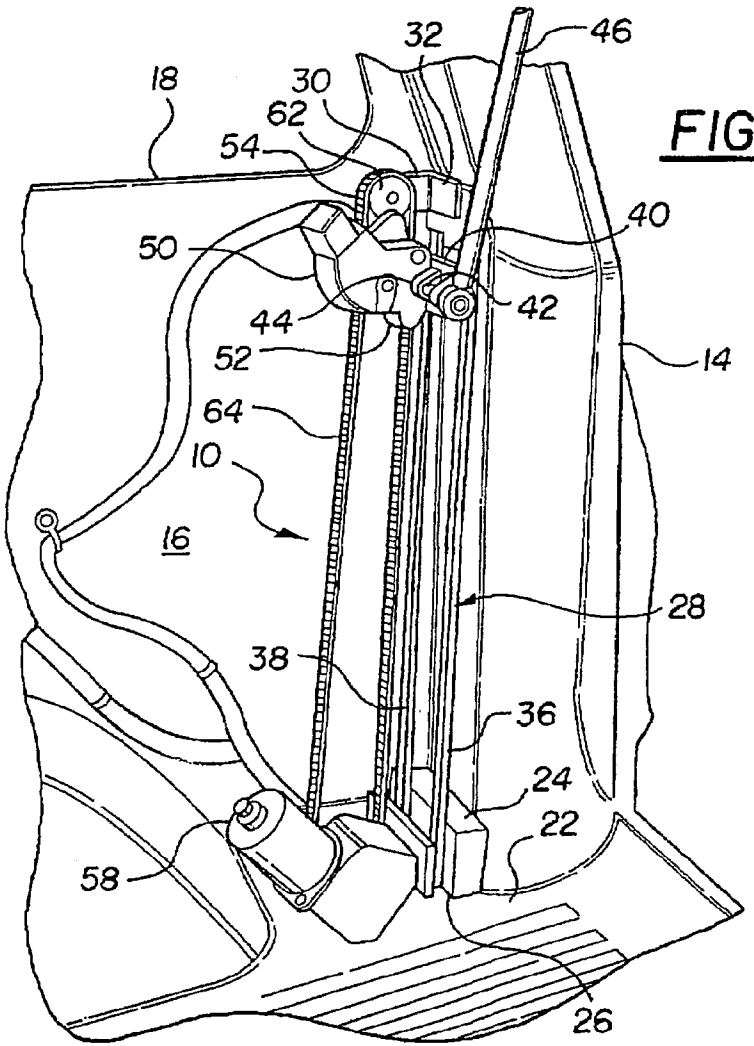
FIG. 1 is a perspective view, partially cut away, of a motor vehicle incorporating the invention.
Figure 6:
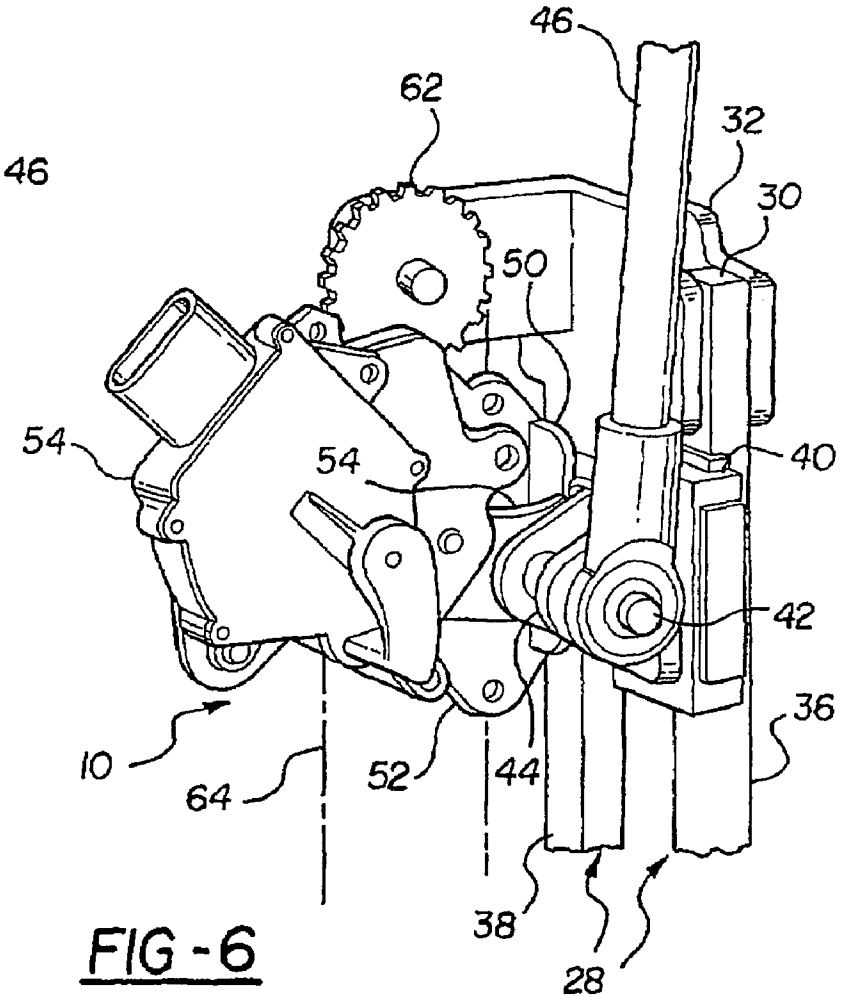
FIG. 6 is a perspective view, partially cut away, of carriage with an engaged latch incorporated into one embodiment of the invention.
Figure 5:
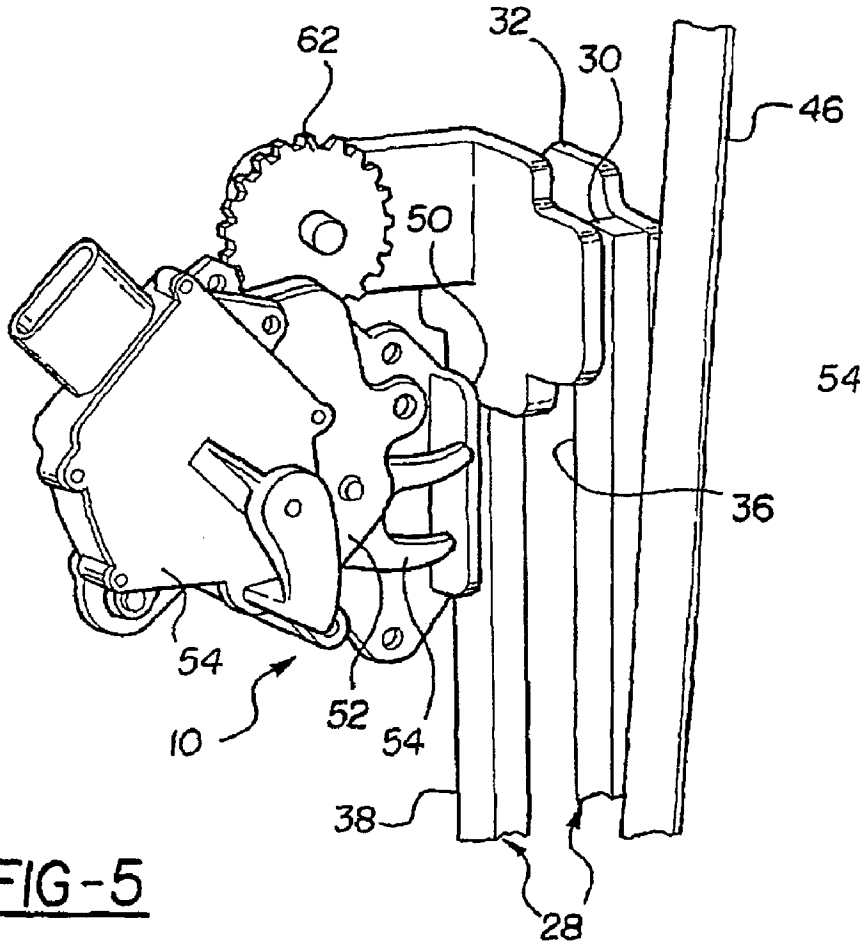
FIG. 5 is a perspective view, partially cut away, of carriage with a disengaged latch incorporated into one embodiment of the invention.
Figure 7:
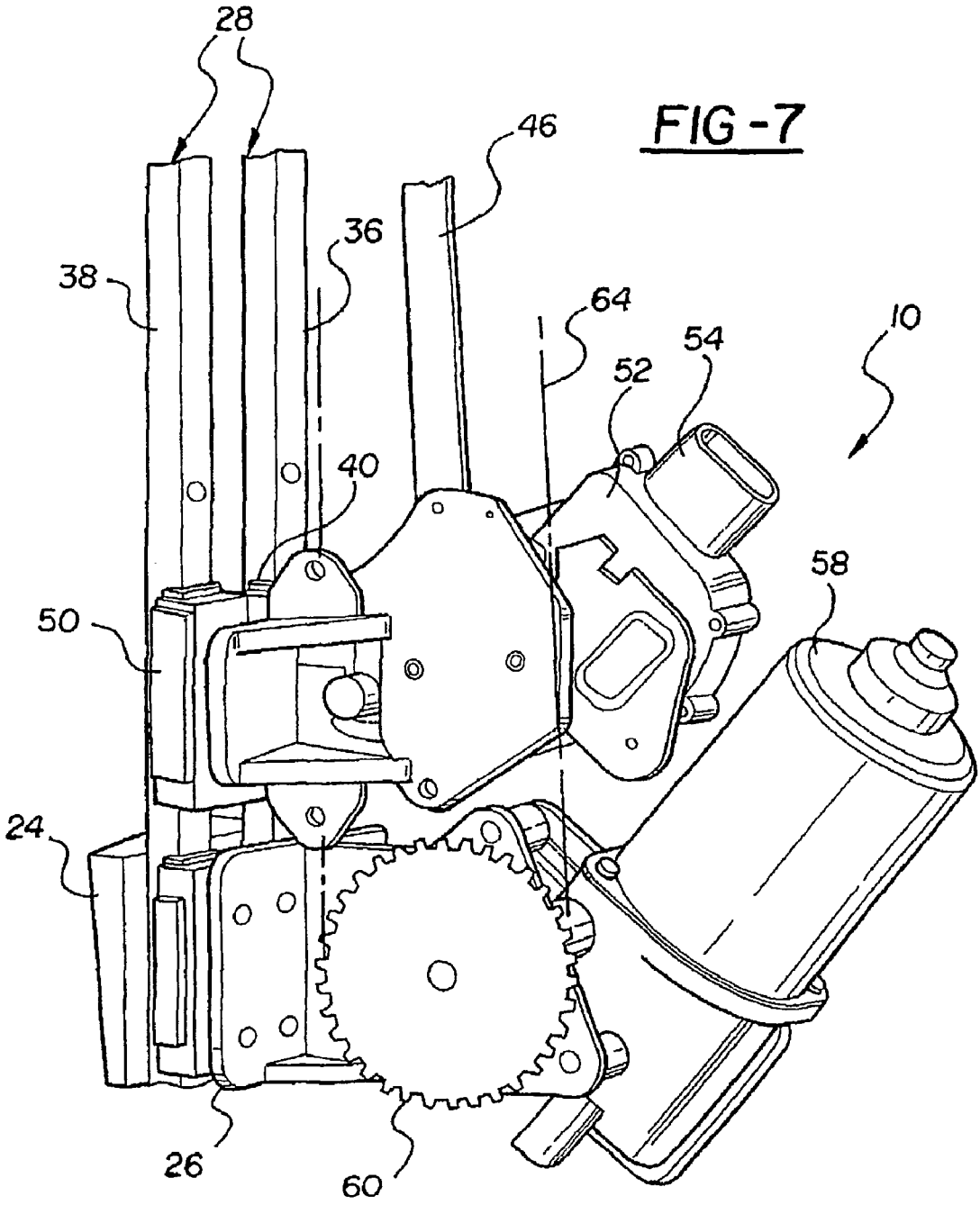
FIG. 7 is a perspective view, partially cut away, of a carriage and drive mechanism incorporated into one embodiment of the invention.

Referring to the Figures, wherein like reference characters represent like or corresponding elements throughout the several views, a power liftgate assembly is generally shown at 10. The power liftgate assembly 10 is used to move a liftgate 12 of a motor vehicle 14 between an open position and a closed position (shown in FIG. 2). Typically, the liftgate 12 provides access to a compartment 16 of the motor vehicle 14. The compartment 16 is defined by at least two sides 18 (one shown), a ceiling 20, a load floor 22, a front (not shown) and the liftgate 12.

The power liftgate assembly 10 includes a base 24. The base 24 is secured to the side 18 and disposed adjacent the load floor 22. It should be appreciated by those skilled in the art that the base 24 could also be secured to the load floor 22.

The base 24 includes a bracket 24 and a guide frame 26. The guide frame 26 is secured to the bracket 24 with a guide, generally shown at 28, extending therebetween. The guide 28 extends upwardly from the base 24. The guide 28 is generally parallel to the side 18 and the liftgate 12 when the liftgate 12 is in its closed position. The guide 28 extends up to a distal end 30 which is also disposed adjacent the side 18 of the motor vehicle 14. The distal end 30 is secured to the side with an upper bracket 32. As is shown in FIG. 2, the base 24, guide 28 and upper bracket 32 may be covered with a protective housing 34.

The guide 28 includes two guide rails 36, 38. The two guide rails include a carriage guide rail 36 and a power guide rail 38. The two guide rails 36, 38 are parallel to each other and extend between the base 24 and the upper bracket 32.

The carriage guide rail 36 is designed to receive a liftgate carriage 40 thereon. The liftgate carriage 40 is slideable along the carriage guide rail 36 over the extent of the liftgate carriage 40.

The liftgate carriage 40 includes a striker bar 42. The striker bar 42 extends across a portion of the liftgate carriage 40 in a direction perpendicular to the carriage guide rail 36. The striker bar 42 is held in its orientation with a striker bar frame 44.

Extending off of one end of the striker bar 42 is a liftgate rod 46. The liftgate rod 46 is pivotally connected to the liftgate carriage 40, via the striker bar 42, and the liftgate 12. The liftgate rod 46 does not slide with respect to the liftgate 12; it only pivots about a liftgate pivot point 48. The liftgate rod 46 translates the linear movement of the liftgate carriage 40 into the pivotal movement of the liftgate 12 which, in turn, moves the liftgate 12 between its open and closed positions.

A power slide carriage 50 is connected to and slideable along the power guide rail 38. The power slide carriage 50 includes a latch 52 that is fixedly secured thereto. The latch 52 includes a U-shaped latch plate 54 designed to selectively receive the striker bar 42 therein. An actuator 56 moves the latch plate 54 between a latching position and a non-latching position. In one embodiment, the actuator 56 includes a solenoid (not shown).

The power slide carriage 50 is moved up and down the power guide rail 36 by a motor 58. The motor 58 is powered by a voltage from the electrical system of the motor vehicle 14. The motor 58 provides a bidirectional rotational force through an output shaft (not shown). The rotational force of the output shaft is transferred to a transmission gear 60. The transmission gear 60 transmits the rotational motion thereof to an upper gear 62 via a chain link 64. It should be appreciated by those skilled in the art that the gears 60, 62 and chain 64 may be substituted with other known linking systems. A non-exhaustive list may include a belt/pulley combination or a transmission gear/worm gear combination.

The power slide carriage 50 is fixedly secured to a specific section of the chain 64. More specifically, as the chain 64 is moved about the gears 60, 62, the power slide carriage 50 moves along therewith. Therefore, it should be appreciated that the chain 64 does not travel completely through the loop created thereby as the power slide carriage 50 would not operate if its orientation were reversed due to travel along the return portion of the chain 64.

In operation, the power liftgate assembly 10 provides for manual and powered movement of the liftgate 12 between its open and closed positions. The power liftgate assembly 10 incorporates a latch 52 that will only engage the striker bar 42 when activated to move the liftgate to the position opposite of its current position. Once in that position, the actuator 56 moves the latch plate 54 to release the striker bar 42. If the liftgate 12 is closed, it will remain closed until a switch (not shown) is activated to engage the motor 58 to open the liftgate 12 or until the manual liftgate latch (not shown) is operated to manually open the liftgate 12.

If the liftgate 12 is in the open position, a gas cylinder or strut 66 will hold the liftgate 12 in the open position. Manual force or the force from the motor 58 will overcome the gas strut 66 allowing the liftgate 12 to return to its closed position.

The invention has been described in an illustrative manner. It is to be understood that the terminology which has been used is intended to be in the nature of words of description rather than of limitation. Many modifications and variations of the invention are possible in light of the above teachings. Therefore, within the scope of the appended claims, the invention may be practiced other than as specifically described.

We claim:

1. A power liftgate drive assembly adapted for moving a liftgate of a motor vehicle between an open position and a closed position, said power liftgate assembly comprising:

a base fixedly secured to the motor vehicle;

a guide defining a smooth side surface and extending upwardly from said base and disposed adjacent the liftgate when the liftgate is in the closed position, said guide including a carriage guide rail and a power guide rail, each of said carriage guide rail and said power guide rail extending upwardly from said base;

a liftgate carriage abutting said smooth side surface of to said guide and linearly slideable therealong; and a liftgate rod pivotally connected to said liftgate carriage and the liftgate such that said liftgate rod translates the linear movement of said liftgate carriage into pivotal movement of the liftgate to move the liftgate between the open and closed positions.

2. A power liftgate assembly as set forth in claim 1 wherein said carriage guide rail and said power guide rail are parallel to each other.

3. A power liftgate assembly as set forth in claim 2 including a motor fixedly secured to said base, said motor including an output gear for outputting a rotational force.

4. A power liftgate assembly as set forth in claim 3 including a power slide carriage connected to and slideable along said power guide rail.

5. A power liftgate assembly as set forth in claim 4 including a transmission connected to said output gear and extending along said power guide rail, said transmission transferring the rotational force along said power guide rail.

6. A power liftgate assembly as set forth in claim 5 wherein said power slide carriage engages said transmission and is moved along said power guide rail by said transmission.

7. A power liftgate assembly as set forth in claim 6 including a latch fixedly secured to said power slide carriage and selectively engagable with said liftgate carriage linking said liftgate carriage to said power slide carriage such that movement of said power slide carriage translates directly to movement of said liftgate carriage.

8. A power liftgate assembly as set forth in claim 7 including an actuating solenoid fixedly secured to said power slide carriage for moving said latch between a disengage position and an engaged position to selectively engage said liftgate carriage.

9. A power liftgate assembly as set forth in claim 8 wherein said transmission includes a transmission gear rotatably secured to one end of said power guide rail and a chain extending between said output gear and said transmission gear.

10. A power liftgate drive assembly adapted for moving a liftgate of a motor vehicle between an open position and a closed position, said power liftgate assembly comprising:

base fixedly secured to the motor vehicle;

a motor fixedly secured to said base, said motor including an output gear for outputting a rotational force;

a guide defining a smooth side surface and extending upwardly from said base and disposed adjacent the liftgate when the liftgate is in the closed position, said guide including a carriage guide rail and a power guide rail, each of said carriage guide rail and said power guide rail extending upwardly from said base;

a liftgate carriage abutting said smooth side surface of to said guide and linearly slideable therealong, said liftgate carriage being moved by said motor; and a liftgate rod pivotally connected to said liftgate carriage and the liftgate such that said liftgate rod translates the linear movement of said liftgate carriage into pivotal movement of the liftgate to move the liftgate between the open and closed positions.

11. A power liftgate assembly as set forth in claim 10 wherein said carriage guide rail and said power guide rail are parallel to each other.

12. A power liftgate assembly as set forth in claim 11 including a top bracket securing said carriage guide rail and said power guide rail to the motor vehicle.

13. A power liftgate assembly as set forth in claim 12 including a power slide carriage connected to and slideable along said power guide rail.

14. A power liftgate assembly as set forth in claim 13 including a transmission connected to said output gear and extending along said power guide rail, said transmission transferring the rotational force along said power guide rail.

15. A power liftgate assembly as set forth in claim 14 wherein said power slide carriage engages said transmission and is moved along said power guide rail by said transmission.

16. A power liftgate assembly as set forth in claim 15 including a latch fixedly secured to said power slide carriage and selectively engagable with said liftgate carriage linking said liftgate carriage to said power slide carriage such that movement of said power slide carriage translates directly to movement of said liftgate carriage.

17. A power liftgate assembly as set forth in claim 16 including an actuating solenoid fixedly secured to said power slide carriage for moving said latch between a disengage position and an engaged position to selectively engage said liftgate carriage.

18. A power liftgate assembly as set forth in claim 17 wherein said transmission includes a transmission gear rotatably secured to said top bracket and a chain extending between said output gear and said transmission gear.

* * * * *

UNITED STATES PATENT AND TRADEMARK OFFICE

CERTIFICATE OF CORRECTION

PATENT NO. : 7,021,003 B2
APPLICATION NO. : 10/258827
DATED : April 4, 2006
INVENTOR(S) : Daniels et al.

It is certified that error appears in the above-identified patent and that said Letters Patent is hereby corrected as shown below:

In claim 1, lines 11-12, between "of" and "said guide" please delete, --to--.

In claim 10, lines 13-14, between "of" and "said guide" please delete, --to--.

Signed and Sealed this

First Day of August, 2006

JON W. DUDAS
*Director of the United States Patent and Trademark Office*